US005794343A

United States Patent [19]

Lee et al.

[11] Patent Number: 5,794,343

[45] Date of Patent: Aug. 18, 1998

[54] RAZOR BLADE ASSEMBLY

[75] Inventors: Alejandro Lee, Cambridge; William C. Carson, III, Acton; Douglas R. Kohring, Chelmsford, all of Mass.

[73] Assignee: The Gillette Company, Boston, Mass.

[21] Appl. No.: 854,573

[22] Filed: May 12, 1997

[51] Int. Cl.[6] ..... B26B 21/14

[52] U.S. Cl. ..... 30/50; 30/77

[58] Field of Search ..... 30/47, 50, 77, 30/81

[56] References Cited

U.S. PATENT DOCUMENTS

| | | | |
|---|---|---|---|
| D. 245,460 | 8/1977 | Poisson | D28/46 |
| D. 322,689 | 12/1991 | Jacobson et al. | D28/47 |
| D. 345,232 | 3/1994 | Gray | D28/46 |
| 1,497,647 | 6/1924 | Smith | 30/34 |
| 3,138,865 | 6/1964 | Meyer | 30/34 |
| 3,722,090 | 3/1973 | Dawidowicz | 30/32 |
| 5,067,238 | 11/1991 | Miller et al. | 30/50 |
| 5,191,712 | 3/1993 | Crook et al. | 30/34.2 |
| 5,249,361 | 10/1993 | Apprille, Jr. | 30/77 |
| 5,416,973 | 5/1995 | Brown et al. | 30/34.2 |
| 5,426,851 | 6/1995 | Gilder et al. | 30/50 |
| 5,526,567 | 6/1996 | Carson, III et al. | 30/50 |
| 5,546,660 | 8/1996 | Burout et al. | 30/50 |
| 5,661,907 | 9/1997 | Apprille, Jr. | 30/50 |

FOREIGN PATENT DOCUMENTS

| | | | |
|---|---|---|---|
| 0 353 919 | 2/1990 | European Pat. Off. | B26B 21/52 |
| 0 684 020 A2 | 11/1995 | European Pat. Off. | A61C 17/22 |
| 385 938 | 6/1988 | Germany | B26B 21/02 |
| 196 06 638 A1 | 8/1996 | Germany | B26B 19/42 |
| 1 557 177 | 12/1979 | United Kingdom | B26B 21/54 |
| 8825268 | 4/1990 | United Kingdom . | |
| WO 96/35558 | 11/1996 | WIPO | B26B 21/40 |

*Primary Examiner*—Hwei-Siu Payer
*Attorney, Agent, or Firm*—Edward S. Podszus

[57] ABSTRACT

A razor blade assembly includes an elongate platform supporting a pair of blades and an elongate guard member disposed adjacent a forward edge of the platform. The guard member has a plurality of fins each spaced one from the other. In preferred embodiments each fin has its uppermost surface below a rearwardly disposed fin and the uppermost surfaces collectively lie on an outwardly convex arcuate surface, and each successively rearward fin is inclined more towards the leading blade edge than the preceding adjacent fin. The elongate platform is provided with a plurality of apertures extending through the platform between a plurality of webs and the guard member is molded in place onto the platform. Portions of the guard member material flow through the apertures and surround webs during the molding process to maintain the guard member in place.

26 Claims, 7 Drawing Sheets

RAZOR BLADE ASSEMBLY

BACKGROUND OF THE INVENTION

The present invention relates to a razor blade structure and more particularly to a guard to be employed in combination with a blade or blades in a razor or razor cartridge.

In U.S. Pat. No. 3,724,070, issued Apr. 3, 1973, in the name of Francis W. Dorion, Jr., there is disclosed a blade assembly in which blade means are held between the blade assembly surfaces adapted to engage the surface being shaved in front of and behind, respectively, cutting portions of the blade means. Such surfaces are generally referred to in the prior art as "guard" and "cap" surfaces.

Various combinations of guard, cap and blade means have been disclosed in the prior art. Typical combinations are disclosed in U.S. Pat. No. 4,168,571, issued Sep. 25, 1979, in the name of John F. Francis, in which the guard, cap and blade means are each movable independently of each other; U.S. Pat. No. 4,270,268, issued Jun. 2, 1981, in the name of Chester F. Jacobson; and U.S. Patent application Ser. No. 659,430, filed Mar. 21, 1991, in the name of Alan Crook now abandoned. Further disclosures of such combinations may be found in U.S. Pat. Nos. 4,270,268; 4,488,357; 4,492,024; 4,492,025; 4,498,235; 4,551,916; 4,573,266; 4,586,255; 4,378,634; 4,587,729; and 4,621,424, all issued in the name of Chester F. Jacobson and assigned to the assignee of the present invention.

In U.S. Pat. No. 5,249,361, issued Oct. 5, 1993, to Domenic V. Apprille, Jr. et al., and assigned to the assignee of the present invention, there is disclosed a razor blade body in the form of a cartridge structure which includes a guard member assembled forward of, and extending parallel to, the blade or blades of a razor cartridge. The guard is of a two-part molded structure having an upper portion of elastomeric material with a plurality of upwardly projecting protrusions, and a lower base portion of rigid plastic material, preferably polypropylene. The lower base portion of rigid plastic material has a downwardly projecting V-shaped crosssectional portion and a pair of projecting elements disposed in spaced relation in the blade cartridge and separated so as to form a recess in which the V-shaped base portion is received. The two-part guard comprising the upper portion of elastomeric material and the base portion of rigid plastic material has been marketed by the assignee of the present application under the trade designation "Sensor Excel" and has met with customer acceptance and has proven to be commercially successful.

As disclosed in the above-cited U.S. Pat. No. 5,249,361, the guard member is manufactured of two distinct components which are formed together prior to assembly in the razor blade structure requiring a separate manufacturing step to produce the guard member, prior to its installation into the razor blade assembly. Additionally, the final combination of the portion of elastomeric material and the base portion of rigid plastic material are of necessity larger in the fore to aft width dimension than would be a single elastomeric material unit installed directly into the razor blade structure. The configuration of the upwardly projecting protrusions, and their location relative to the blades, and to one another, is therefore more restricted than would be the situation should the guard member be provided as a unitary element, supported within the razor blade assembly structure.

It is therefore an object of the present invention to provide a razor blade assembly having a guard member, wherein the guard member is molded in situ onto the blade supporting structure.

A further object of the invention is to provide an elongated guard member formed adjacent the forward edge of the razor blade structure which comprises a base portion and a plurality of fins which are spaced one from the other, each fin having its uppermost surface below a rearwardly disposed fin.

A yet further object of the invention is to provide an elongated guard member formed adjacent the forward edge of the razor blade structure which comprises a base portion and a plurality of fins which are spaced one from the other, each fin being more rearwardly inclined towards the primary blade than a more forward fin.

Yet another object of the invention is to provide a guard member which is easily assembled into a razor blade structure.

Still another object of the invention is to provide a razor blade assembly which is simple in construction and therefore economical to manufacture.

Still a further object of the invention is to provide a method of manufacturing a razor blade structure wherein the guard member may be simply formed into a plurality of configurations, as desired.

SUMMARY OF THE INVENTION

The above objects and other objectives which will become apparent as the description proceeds are achieved by providing a razor blade assembly having an elongated platform and at least one blade member disposed on the platform. An elongated guard member is molded directly onto the platform during the manufacturing process.

The platform is generally formed of a rigid plastic material while the elongated guard member generally comprises an elastomeric material. The elastomeric material may be in the hardness range of 27 to 75 when measured on the Shore A hardness scale and the platform is provided with a plurality of apertures through which the guard member is molded to maintain the guard member in interlocking engagement with the platform.

The elongated guard member is formed adjacent a forward edge of the elongated platform and may comprise a base portion with a plurality of fins each spaced one from the other and having its uppermost surface below that of a rearwardly disposed fin.

The base portion of the guard member is generally formed of a substantially arcuate surface from which the fins extend, the fins being of a maximum thickness at the base portion and tapering to a minimum thickness at the uppermost surface.

BRIEF DESCRIPTION OF THE DRAWINGS

Reference is made to the accompanying drawings in which there is shown an illustrative embodiment of the invention from which its novel features and advantages will be apparent, wherein.

DESCRIPTION OF THE PREFERRED EMBODIMENTS

Figure 1:
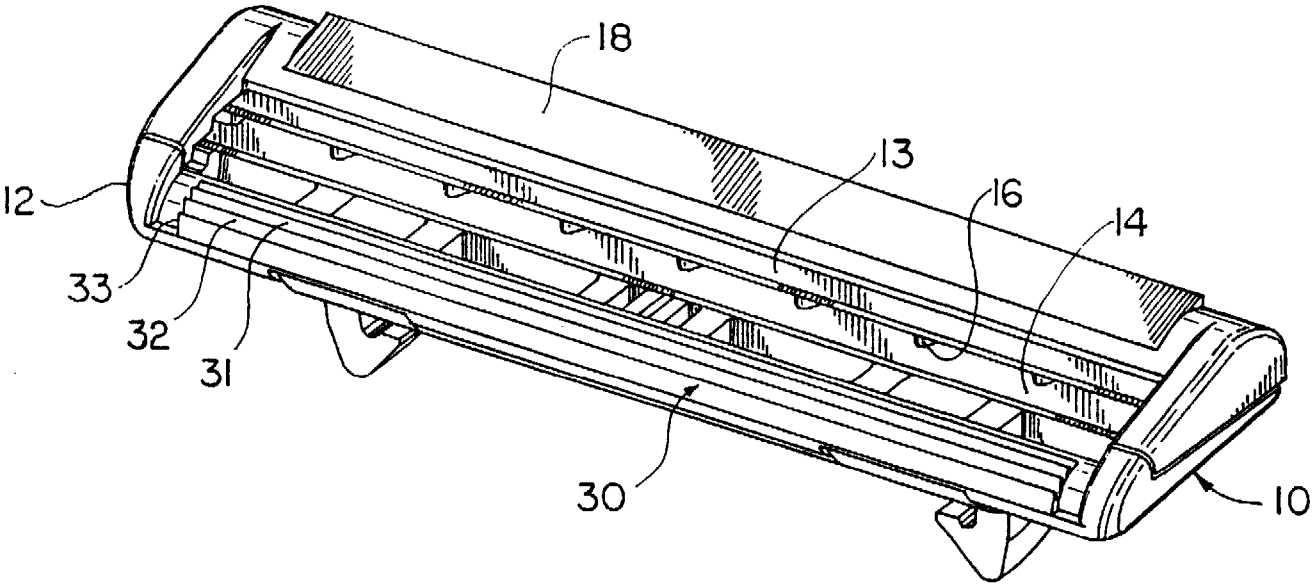
FIG. 1 is a front elevational perspective view showing a razor blade assembly for use in a shaving instrument and constructed in accordance with the teachings of the present invention.
Figure 2:
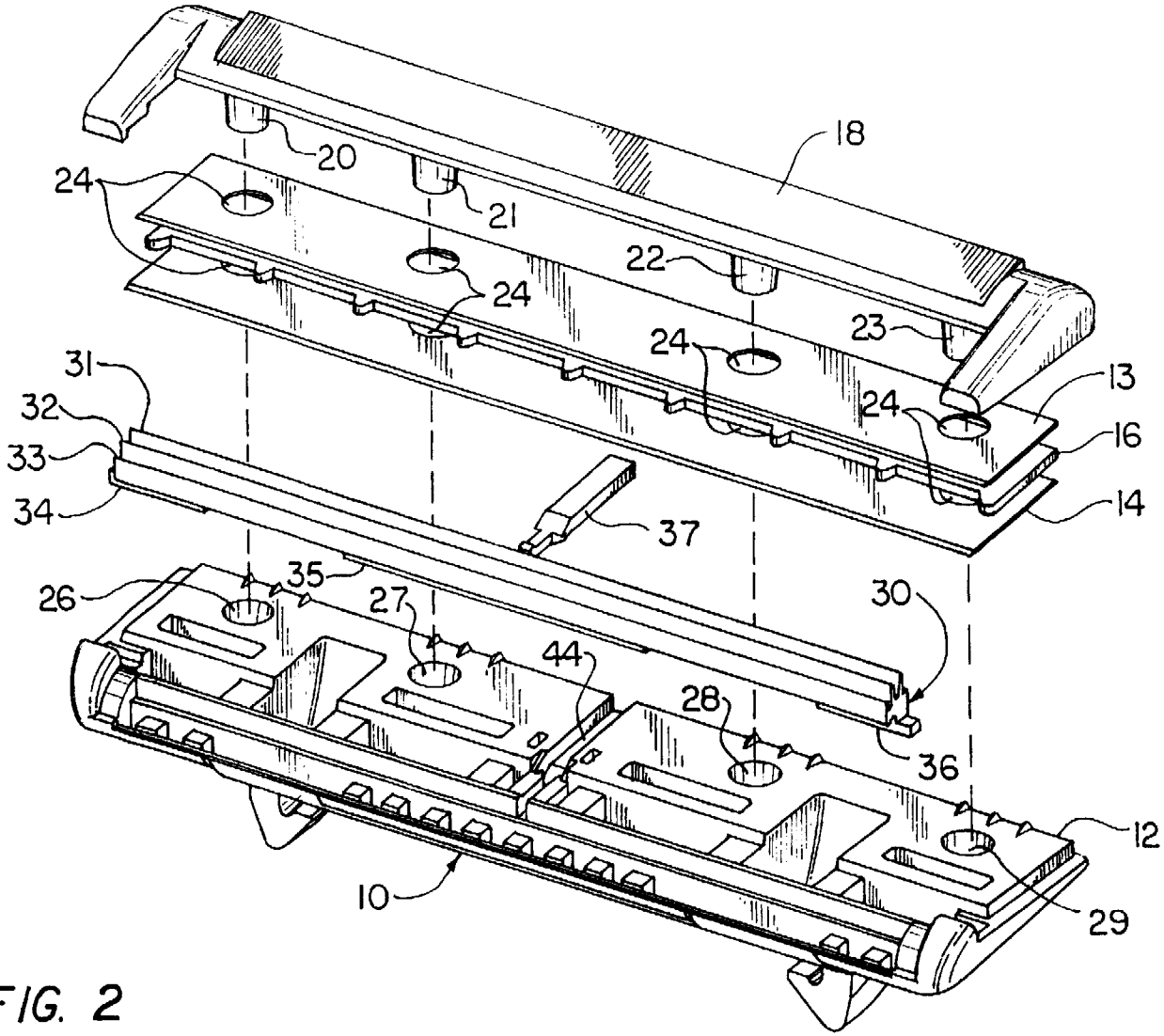
FIG. 2 is a front elevational exploded view showing the various elements of the structure of FIG. 1.

Referring now to the drawing and in particular to FIGS. 1 and 2 there is shown a razor blade assembly 10 comprising an elongated platform 12 for supporting a pair of blades 13 and 14, having a spacer 16 disposed between the blades and separating the blades one from the other. A cap member 18 is provided with four cylindrical rivets 20, 21, 22 and 23 which when assembled to the platform 12 extend through a plurality of circular openings 24 in the blades 13 and 14 and the spacer 16, and are received in the circular bores 26, 27, 28 and 29 formed in the platform 12.

A guard member 30 having upwardly projecting fins 31, 32 and 33 is disposed at the forward edge of the platform 12. The guard member 30 is formed in situ onto the platform 12 and has portions 34, 35 and 36 which are disposed on the opposite surface, or undersurface of the platform, and a portion 37 formed in a groove 44 provided on the platform 12. It should be understood that the guard member 30 being molded directly onto the platform 12 will not appear separately as depicted in FIG. 2, as the portions 34, 35 and 36 are molded through apertures in the platform and would be severed from the guard member, if the guard member were removed from the platform. The element 30 of FIG. 2 is therefore presented as a separate unit to show details of the various components of the razor blade assembly 10.

Further, while the guard member 30 is depicted herein to be formed on a portion of a razor structure having a pair of stationary blades 13 and 14, it should be understood that the guard member herein to be described may be employed in either a razor structure, or a cartridge, and may be employed with a single blade, multiple blades or in combination with movable blades as shown in the aforementioned U.S. Pat. No. 5,249,361, issued to Apprille et al.

Referring now to FIGS. 3 through 10, the platform 12, which is combined in the razor blade structure 10 shown in FIGS. 1 and 2, is manufactured of a polypropylene material to provide the necessary rigidity for supporting the blades 13 and 14. The platform is provided with a plurality of rectangular webs 38 which extend upwardly from a surface 39 adjacent the forward edge of the platform, and a plurality of apertures 40 are formed between the webs 38 to extend through the surface 39 and are open at the underside of the platform 12. Portions of the elastomeric material of guard member 30 surround webs 38.

The platform 12 of the present embodiment further comprises a pair of attachment members 42 and 43 which are provided to assemble the razor blade structure onto a handle (not shown). The assembly of the razor blade structure 10 onto a suitable handle will not be discussed or described herein as such handles and methods of attachment are well known in the art, may take many forms, and constitute no part of the present invention.

Prior to the assembly of the platform 12 into the razor blade assembly 10, the elongate guard member 30 is injection molded onto the platform by providing a suitable mold and injection molding machinery (not shown) which may be of any type well known in the art to achieve the configuration as described herein.

The elongate guard member 30 is generally manufactured of a thermoplastic elastomeric material which is chosen to provide a flexibility in the upstanding ribs 31, 32 and 33 to provide the preferred tactile sensation to the skin during the shaving process. In order to produce this flexibility, the chosen materials generally have a hardness value in the range of 27 to 75 on the Shore A scale, and materials which may be selected are Kraton G2705 having a hardness of 55 on the Shore A scale which is manufactured by the Shell Corporation, Evoprene #966 having a Shore A hardness value of 27 and distributed by Gary Chemical Corporation of Leominster, Mass., Santoprene 271-55 having a Shore A hardness value of 55 and Santoprene 271-73 having a Shore A hardness value of 73, both manufactured by Advanced Elastomerics Corporation.

While the elongate guard member 30 may be injected in any manner to produce the desired configuration, in the present embodiment the injection takes place at the rear of the platform 12 through a groove 44 provided for that purpose. As the material flows through the groove 44 the portion 37 is formed in the groove and the material is restrained within the mold to produce the fins 31, 32, and 33, and extends downwardly through the apertures 40 and around the rectangular webs 38 forming the elongate portions 34, 35 and 36 on the underside of the platform 12 as shown in FIG. 2. This provides a locking of the flexible material onto the more rigid platform 12 retaining the guard member 30 in a fixed position under the platform. Furthermore, chemical affinity between the two plastics assists the bond. This arrangement advantageously provides the ease of manufacturing the second stage molding within the same mold cavity, and then removing the entire finished subassembly formed of platform 12 and guard member 30.

In the present embodiment, the razor blade structure 10 when connected to a suitable handle (not shown) is intended to be rotatable about the handle. However, even without this feature, it is considered that during the shaving process the razor blade assembly will be rotated slightly. It is therefore highly desirably that the fins 31, 32 and 33 conform to the radial surfaces at the forward edge of the platform 12 so as to increase the smoothness of flow of the razor structure over the skin during the shaving operation. As the guard member 30 is now a single unitary element, a great deal of latitude exists in molding the guard member onto the structure of the platform 12.

Figure 9:
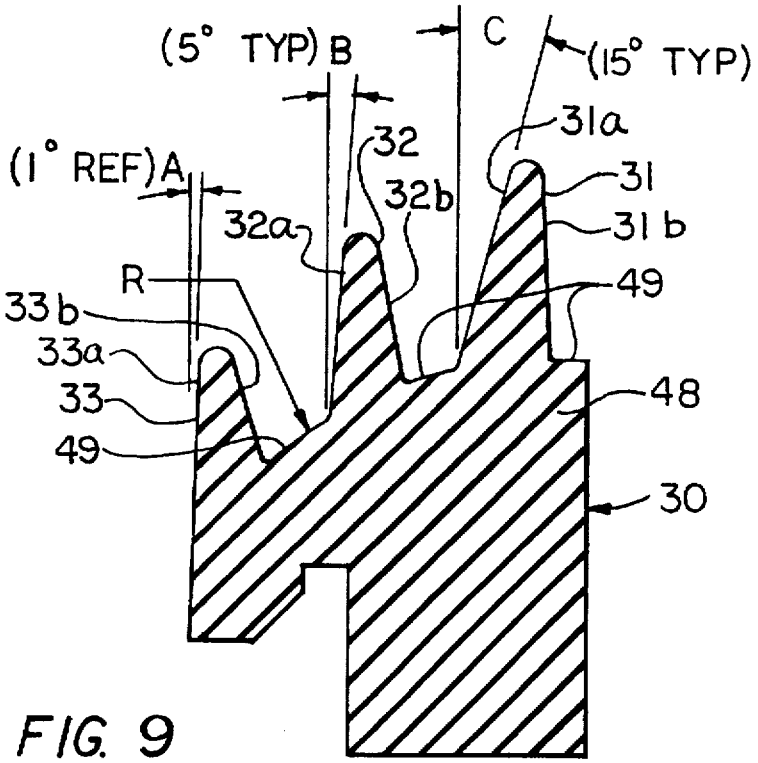
FIG. 9 is a cross-sectional view of a portion of he structure of FIG. 8, taken on an enlarged scale for clarity.

As best shown in FIG. 9, the elongate guard member 30 in present structure is molded to provide a base portion 48 having a radial surface 49 from which the fins 31, 32 and 33 extend upwardly. The fins 31, 32, 33 extend generally perpendicular to the cutting path of cutting edges of blades 13, 14. The fins 31, 32 and 33 are each spaced one from the other, and each has its uppermost surface below that of a rearwardly disposed fin. In order to give a proper flexibility and strength to each of the fins 31, 32 and 33, each fin has a maximum thickness at its base portion and tapers to a minimum thickness at its uppermost surface.

Figure 10:
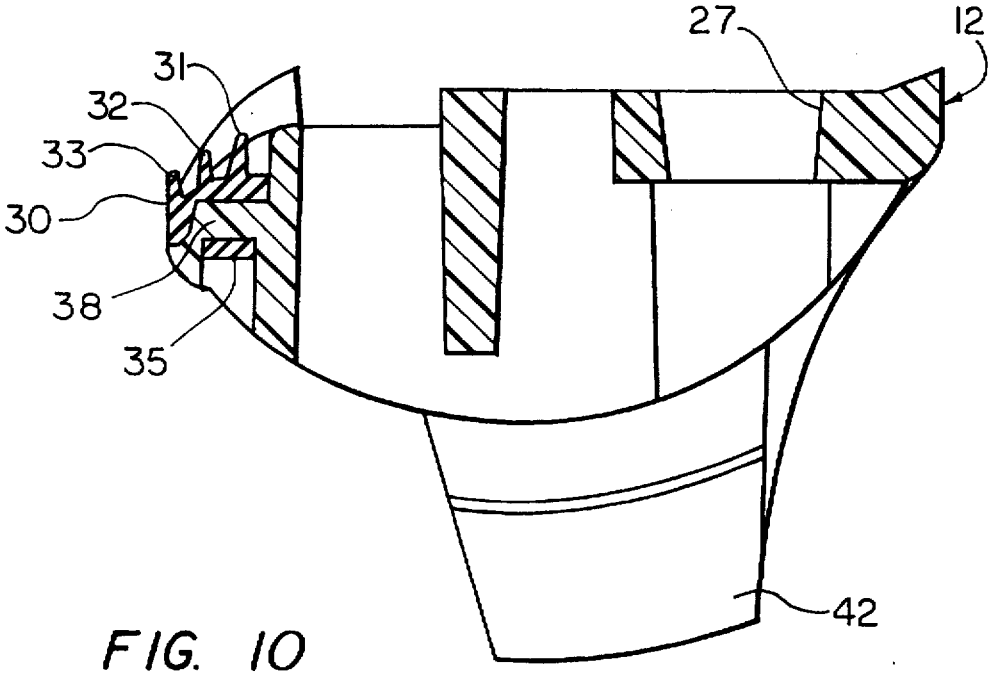
FIG. 10 is an enlarged side elevational sectional view taken along the line X—X of FIG. 4.

As best shown in FIGS. 9 and 10, the fins 31, 32, and 33 have distal ends located away from base portion 48 arranged along a convex arcuate surface. Together the fin distal ends define a guard surface spanning an area greater than the sum of the contact areas defined by the individual distal ends (i.e., the surface defined by the fin distal ends and the spacing between the distal ends is greater than the surface area of the fin distal ends themselves), but due to the comparatively close spacing of the fins 31, 32, 33, the feel to the skin is generally that of a continuous surface. The resiliency of the fins and the higher coefficient of friction of the elastomeric material of the fins than that of the platform material contributes to a pleasant traction force on the skin. Due to the arrangement of fins extending generally perpendicular to the direction of a shaving movement over the skin surface, i.e., the shaving path being generally parallel to the blade edges, a traction force advantageous for shaving is exerted on the skin.

Again referring to FIG. 9, each fin 31, 32, 33 disposed successively more rearward, i.e., in the direction towards the blades 13, 14, is inclined away from the vertical (i.e., towards the blades) more than its forwardly-disposed neighboring fin. As shown in FIG. 9, the leading edge flank 33*a* of fin 33 is approximately vertical at an angle A of about 1° rearward inclination; leading edge flank 32*a* of fin 32 is inclined at angle B of about 50 rearward; and leading edge flank 31*a* of fin 31 is inclined at angle C of about 15° rearward. This disposition of fins 31, 32, 33 is referred to as a splayed or raked back condition, and advantageously provides more skin contact surface within the same base portion 48 spatial envelope than if the fins were only vertical, and without the need to add a greater number of fins closer to primary blade 14, which might otherwise interfere with the exposure of primary blade 14, thus providing good traction force with less material and without impairing blade exposure. The splayed condition also assists parting of the injection mold tool to release the in situ molded cartridge and guard. As shown in FIG. 9, the trailing edge fin flanks 31*b*, 32*b*, 33*b* opposite respective leading edge flanks 31*a*, 32*a*, 33*a* can be inclined towards a median plane bisecting each fin at an angle of inclination away from an upwardly directed vertical axis that is different from the angle of inclination of the respective leading edge flanks to influence the flexibility of each fin.

Figure 8:
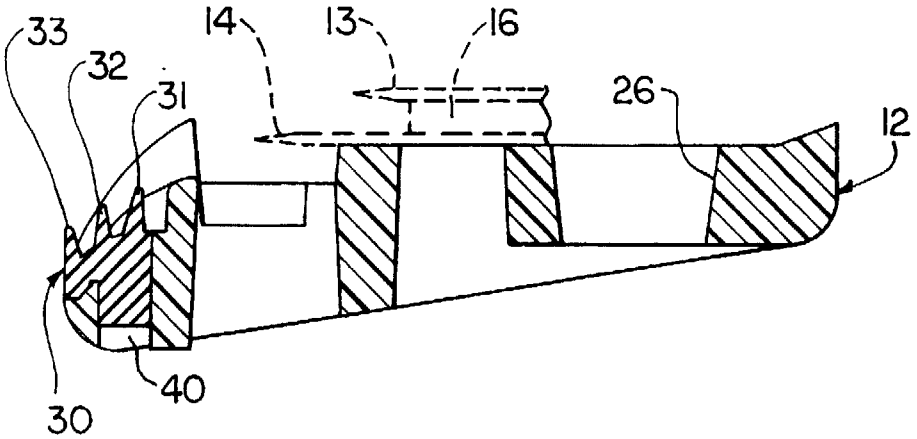
FIG. 8 is an enlarged side elevational sectional view taken along the line VIII—VIII of FIG. 4.

Advantageously, as shown in FIGS. 8 and 10, and in contrast to the assembly shown in the above-cited U.S. Pat. No. 5,249,361 at FIG. 6 therein, the front wall portion of guard member 30 and leading fin 33 do not overhang or extend more forward than the platform 12, thus contributing to resisting peeling or separation of the fin from the platform in the high-friction forward fin area and reducing the user's perception of too "flat" a feeling of orientation to the skin, e.g. face, being shaved. The arrangement of distal ends of fins 31, 32, 33 along a generally convex or arcuate surface formed by the splayed back fins allows a natural fit to curved skin surfaces of the body, such as the face, without pushing the cartridge flat against the skin surface as could result if all the fins terminated in a broad flat surface, while still providing sufficient registration to the skin surface to serve as a message to the user to properly orient the cartridge shaving attitude. Elastomeric fins 31, 32, 33 in this progressively splayed condition provide the advantage of a high friction traction force within a small actual working envelope and helps the user orient the cartridge on the surface being shaved more comfortably than a broad flat fin tip area.

Figure 3:
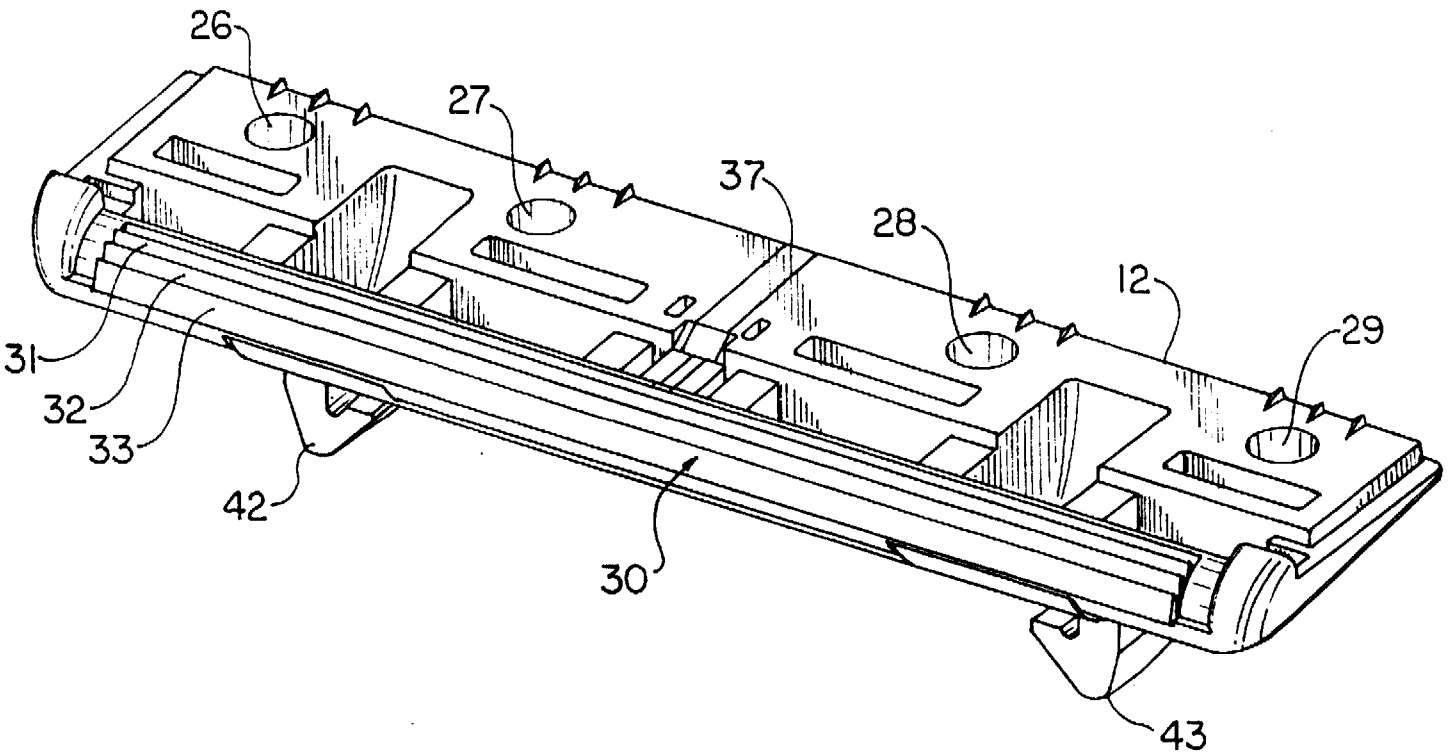
FIG. 3 is a front elevational perspective view similar to FIG. 1, having selected elements of the structure of FIG. 1 removed.
Figure 4:
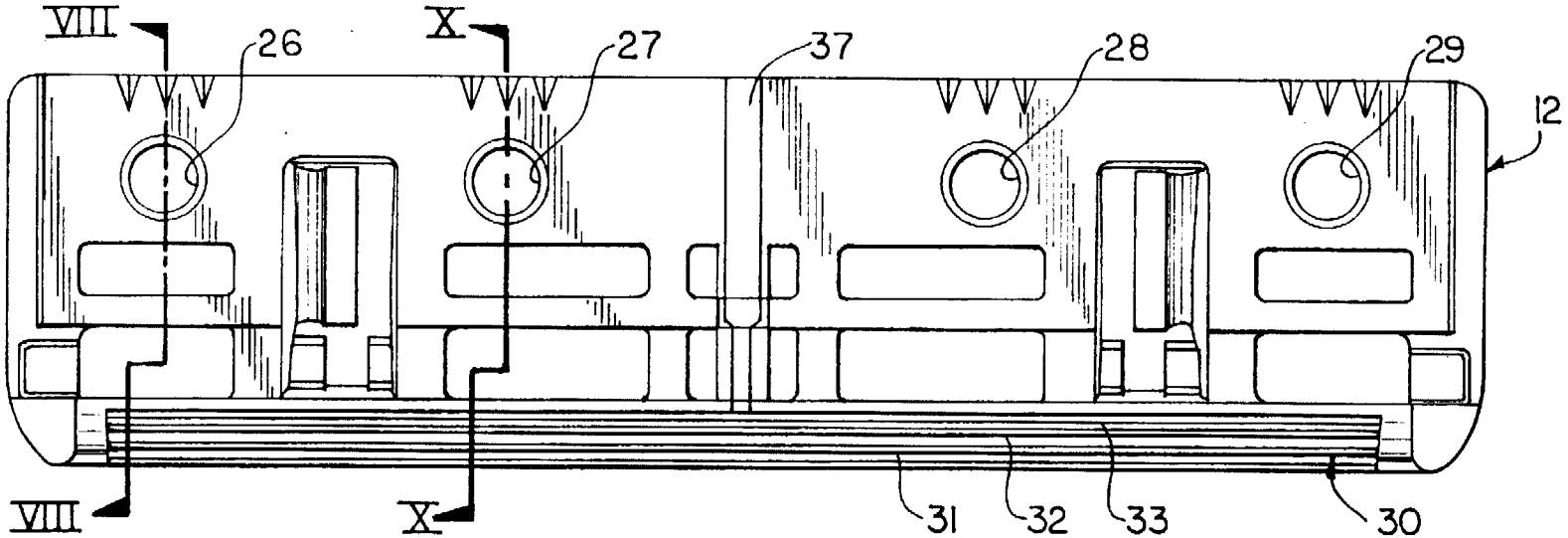
FIG. 4 is a top plan view showing details of the structure of FIG. 3.
Figure 5:
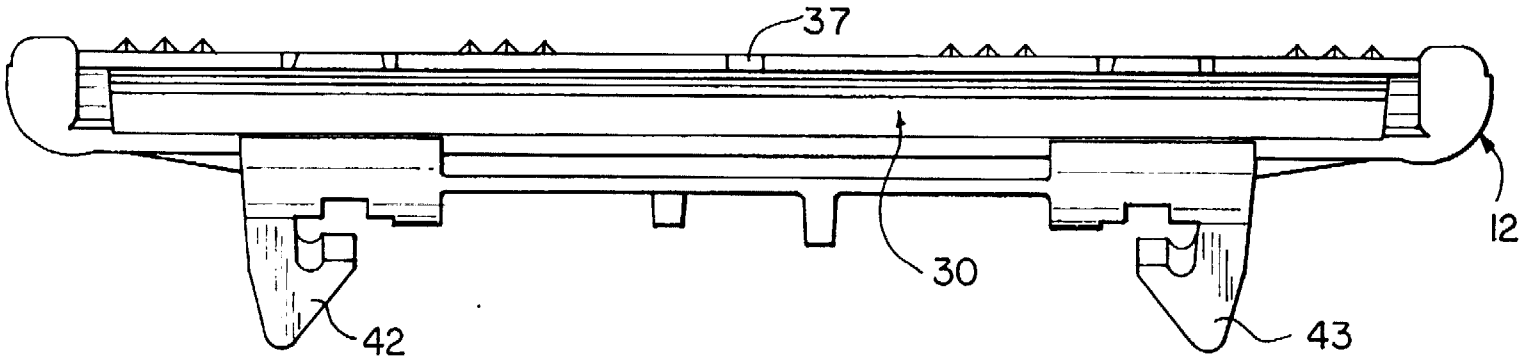
FIG. 5 is a front elevational view showing further details of the structure of FIGS. 3 and 4.
Figure 6:
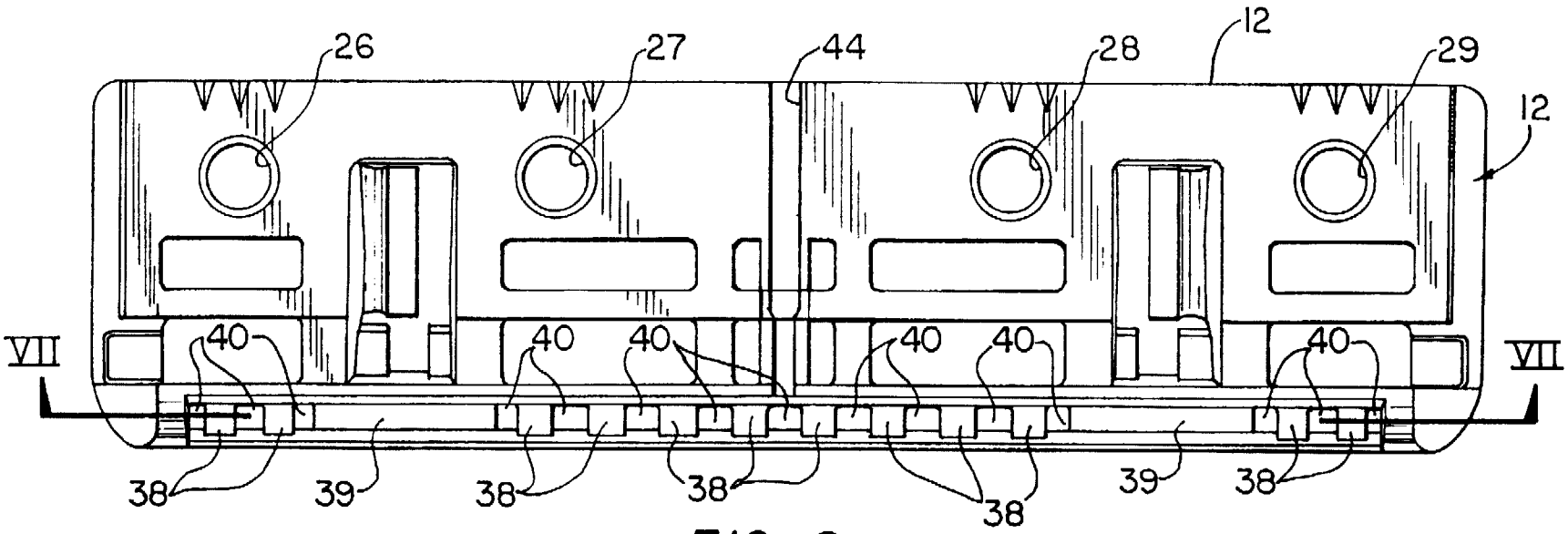
FIG. 6 is a top plan view showing the platform element of the structure of FIGS. 1 through 5.
Figure 7:
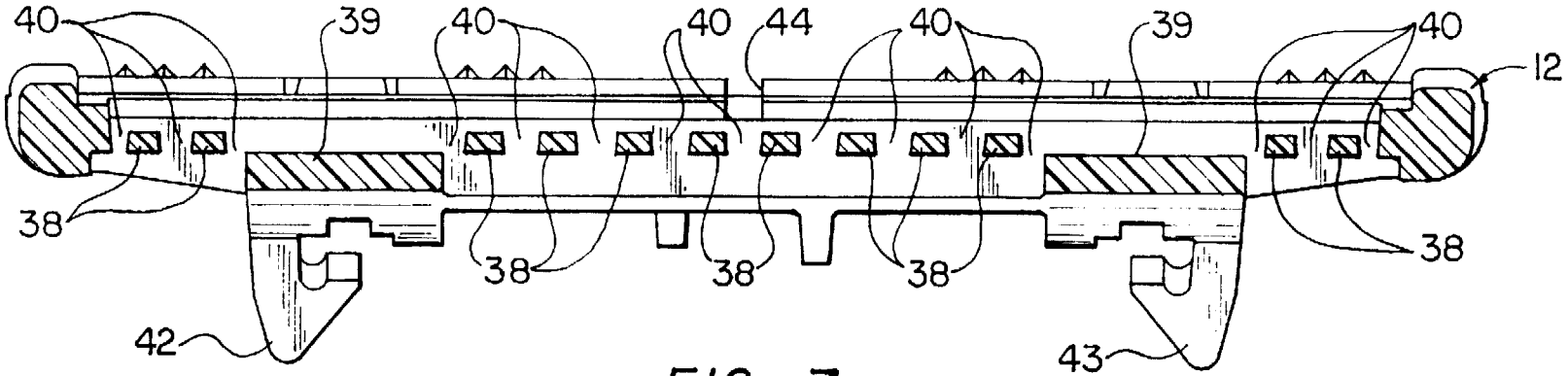
FIG. 7 is a front elevational sectional view taken along the line VII—VII of FIG. 6.

With the elongate guard member 30 molded onto the platform 12 as shown in FIGS. 3, 4 and 5, the blades 13 and 14, spacers 16 and cap member 18 are assembled to produce a razor blade assembly 10 as shown in FIG. 2. A razor blade assembly 10 is, therefore, provided having a guard member 30 of substantially flexible thermoplastic material and a platform 12 of substantially rigid plastic material, the platform being capable of supporting the blades 13 and 14, and of rigid attachment to a handle to complete the razor construction.

While it is apparent that changes and modifications can be made within the spirit and scope of the present invention, it is our intention, however, only to be limited by the appended claims.

As our invention we claim:

1. A safety razor blade unit comprising at least one blade, a razor blade body structure supporting the at least one blade and having a front wall extending parallel with a blade edge and disposed forward of the at least one blade, and an elongated guard member disposed in the razor blade body structure for contacting and stretching a skin surface being shaved in front of the at least one blade during shaving, said guard member comprising a unitary molded member of elastomeric material, said unitary molded member comprising a molded bottom base portion extending downwardly for juxtaposition adjacent the front wall of the body structure along the length of the guard member and a molded upper portion having a plurality of protrusions projecting upwardly therefrom for contacting the skin surface onto which the at least one blade is applied, said protrusions comprising at least three fins extending along an upper surface of said guard upper portion parallel to the blade edge and spaced one from the other, each said spaced apart fin having a fin proximal base and a fin distal edge above said fin base, said fin distal edges being disposed on a substantially arcuate convex surface and successive said fins being inclined more towards said at least one blade than forwardly disposed adjacent fins, wherein the guard member will engage the skin being shaved at a series of separate contact areas spanning an area greater than the sum of contact areas of individual fin distal edges.

2. The razor blade unit of claim 1, wherein said fin distal edges have uppermost surfaces below that of a rearwardly disposed fin.

3. The razor blade unit of claim 1, wherein said guard member molded upper portion is disposed on a generally arcuate convex surface intersecting the fin proximal bases.

4. The razor blade unit of claim 1, wherein each of said fins is of maximum thickness at said proximal base and tapers to a minimum thickness at its said distal edge.

5. The razor blade unit of claim 1, wherein said elastomeric guard member does not extend more forward than a forwardmost portion of the front wall from said at least one blade.

6. The razor blade unit of claim 1, wherein said elastomeric guard member is molded in situ into said razor blade body structure.

7. A razor blade assembly comprising an elongate platform comprising a first plastic material;

at least one blade member disposed on said platform and having a cutting edge generally oriented in a forward direction defining a cutting path; and an elongated guard member comprising a second plastic material and being disposed adjacent the forward edge of said platform and spaced forwardly of said blade member cutting edge, said guard member having a base portion with a plurality of fins disposed thereon;

each of said fins extending upwardly from said base portion and generally perpendicular to said cutting path and each being spaced one from the other and having its uppermost surface disposed below that of a rearwardly disposed fin, said uppermost surfaces collectively intersecting an outwardly convex arcuate surface, whereby a smoothly continuous traction force is exerted on skin of a user as the razor blade assembly changes orientation relative to the skin during shaving.

8. A razor blade assembly as set forth in claim 7 wherein said base portion comprises a substantially arcuate surface from which said fins extend.

9. A razor blade assembly as set forth in claim 8 wherein each of said fins is of maximum thickness at said base portion and tapers to a minimum thickness at its uppermost surface.

10. A razor blade assembly as set forth in claim 7 wherein each of said fins is of maximum thickness at said base portion and tapers to a minimum thickness at its uppermost surface.

11. A razor blade assembly as set forth in claim 7 wherein said guard member is formed of an elastomeric material.

12. A razor blade assembly as set forth in claim 11 wherein said elastomeric material is of a hardness in the range of 27 to 75 measured on the Shore A hardness scale.

13. A razor blade assembly as set forth in claim 7 wherein said fins are inclined towards said at least one blade member more than a forwardly disposed fin.

14. A razor blade assembly comprising an elongate platform provided with a plurality of apertures in spaced relation to a plurality of webs therebetween, at least one blade member disposed on said platform, and an elongated guard member molded in situ onto said platform through said apertures to surround said webs to maintain said guard member in interlocking engagement with said platform.

15. A razor blade assembly as set forth in claim 14 wherein said platform is formed of a rigid plastic material and said elongated guard member comprises an elastomeric material.

16. A razor blade assembly as set forth in claim 14 wherein said guard member is formed of an elastomeric material having a hardness in the range of 27 to 75 measured on the Shore A hardness scale.

17. A razor blade assembly as set forth in claim 14 wherein said elongated guard member is formed adjacent a forward edge of said elongate platform and comprises a base portion with a plurality of fins each spaced one from the other and being inclined towards said at least one blade member more than a forwardly disposed fin.

18. A razor blade assembly as set forth in claim 14 wherein said elongated guard member is formed adjacent a forward edge of said elongate platform and comprises a base portion with a plurality of fins each spaced one from the other and having its uppermost surface below that of a rearwardly disposed fin.

19. A razor blade assembly as set forth in claim 18 wherein said base portion comprises a substantially arcuate surface from which said fins extend.

20. A razor blade assembly as set forth in claim 19 wherein each of said fins is of maximum thickness at said base portion and tapers to a minimum thickness at its uppermost surface.

21. A razor blade assembly as set forth in claim 20 wherein said guard member is formed of an elastomeric material.

22. A razor blade assembly as set forth in claim 21 wherein said elastomeric material is of a hardness in the range of 27 to 75 measured on the Shore A hardness scale.

23. A method of manufacturing a razor blade assembly comprising the steps of providing an elongate platform for supporting at least one blade therein, said platform defining a plurality of apertures extending therethrough, and molding an elongate guard member through said apertures in situ onto said platform in spaced relation with said blade, whereby first portions of said elongate guard member extend through said apertures and second portions of said elongate guard member are disposed on opposite surfaces of said elongate platform.

24. A method of manufacturing a razor blade assembly as set forth in claim 23 further comprises the step of forming said elongate guard member adjacent a forward edge of said elongate platform and forming said guard member with a base portion having a plurality of fins each spaced one from the other and being inclined towards said at least one blade more than a forwardly disposed fin.

25. A method of manufacturing a razor blade assembly as set forth in claim 23 further comprises the step of forming said elongate guard member adjacent a forward edge of said elongate platform and forming said guard member with a base portion having a plurality of fins each spaced one from the other and having its uppermost surface below that of a rearwardly disposed fin.

26. A method of manufacturing a razor blade assembly as set forth in claim 23 further comprises the step of molding said elongate guard member of an elastomeric material.

* * * * *